US005572893A

United States Patent [19]

Goda et al.

[11] Patent Number: 5,572,893

[45] Date of Patent: Nov. 12, 1996

[54] METHOD OF NECKING AND IMPACT EXTRUDED METAL CONTAINER

[76] Inventors: Mark E. Goda, 404 Water St., Fredonia, Pa. 16124; Charles Faloney, 122 Sunset Dr., Jamestown, Pa. 16134

[21] Appl. No.: 347,888

[22] Filed: Dec. 1, 1994

[51] Int. Cl.[6] ..... B21D 51/26

[52] U.S. Cl. ..... 72/254; 72/256; 72/379.4

[58] Field of Search ..... 72/254, 256, 267, 72/379.4, 338; 29/526.6

[56] References Cited

U.S. PATENT DOCUMENTS

| | | | |
|---|---|---|---|
| 1,373,726 | 5/1921 | Heiby et al. | 29/526.6 |
| 3,029,507 | 4/1962 | Gaggini | 72/254 |
| 3,394,578 | 7/1968 | Biginelli | 72/254 |
| 4,457,158 | 7/1984 | Miller et al. | 413/69 |

*Primary Examiner*—Lowell A. Larson

*Attorney, Agent, or Firm*—Laff, Whitesel, Conte and Saret, Ltd.

[57] ABSTRACT

A method of forming an elongated narrowed neck on an impact extruded metal container, in which a larger portion is trimmed from the open end of the container than is necessary merely to produce a straight unwrinkled edge. The trimmed part is sufficiently long that the metal at the new edge formed by trimming comprises substantially more formable metal than the metal which would have been present at the edge produced by normal trimming. The increased formability occurs because excess impurities which migrate to the open edge of the container are largely removed by the deep trim. It is then possible to process the open end through a series of forming dies to produce a long narrowed neck with a much lower reject rate than previously. The method is further assisted by trimming the end of the neck again part way through the series of forming dies, and by maintaining very small clearances in the dies, and by using compressed air in the first few dies to aid in ejecting the containers from the dies.

16 Claims, 17 Drawing Sheets

METHOD OF NECKING AND IMPACT EXTRUDED METAL CONTAINER

FIELD OF THE INVENTION

This invention relates to a method of forming a narrowed, elongated neck on an impact extruded container.

BACKGROUND OF THE INVENTION

Impact extrusion is a well-known process, in which a slug of metal (usually aluminum or an aluminum alloy) is placed in a cylindrical die and struck with a punch at high speed and high pressure. The metal of the slug then flows upwardly to form a thin-wall open ended container. Such containers are commonly used in numerous applications, e.g. as beverage containers, aerosol containers, and to hold various other products.

After the container has been formed, the open end is usually formed into a narrowed neck, and a top (e.g. a spray valve) is applied to the container.

Until the present time, the extent to which the neck has been narrowed has been limited, and the narrowed neck of the container has been of relatively short axial dimension. It has not been easily possible to form a long neck of greatly reduced diameter on one piece impact extruded containers, because of the difficulties encountered when forming the material of the neck. Because the material tends to wrinkle and split when being formed, the reject rate has been unacceptably high. Therefore, when containers having elongated narrow necks have been needed, e.g. to contain liquids to be added to automotive fuel or oil, such containers have usually been made from plastic. Plastic containers have the disadvantage that they may be permeable to compounds in the liquids which they are to contain, and they may even be attacked by such liquids.

BRIEF SUMMARY OF THE INVENTION

Therefore, it is an object of the invention to provide a method and apparatus for providing an elongated reduced diameter neck on a one piece metal container. In one of its aspects the invention provides a method of forming a metal container of predetermined diameter and having an elongated, narrowed neck, said method comprising:

(a) impact extruding a slug to form a container having an open end, said open end being defined by an encircling first edge, (b) trimming a portion from the length of said container at said open end to define a second encircling edge, said portion being longer than that necessary merely to produce a straight unwrinkled edge and being sufficiently long that the metal of said container at said second edge comprises metal which is substantially more formable than the metal of said container at said first edge, (c) inserting said container sequentially into a series of necking dies to form said elongated, narrowed neck at said open end.

In another aspect the invention provides a method of forming a long-necked metal container of predetermined diameter, comprising:

(a) impact extruding a slug to form a container having an open end defined by a first encircling edge, (b) trimming a portion from the length of said container at said open end to form a second encircling edge, (c) inserting said container sequentially into a series of necking dies to form an elongated neck of diameter less than said predetermined diameter at said open end, (d) said necking dies comprising a first plurality of necking dies for partially forming said neck and a second plurality of necking dies for completing the forming of said neck, (e) and after said neck has been partially formed in said first plurality of necking dies but before said neck has been completely formed in said second series of necking dies, trimming a further portion from the open end of said neck to form a straight smooth edge thereat.

In another aspect the invention provides a method of forming a long-necked metal container of predetermined diameter, comprising:

(a) impact extruding a slug to form a container having an open end defined by a first encircling edge, (b) trimming a portion from the length of said container at said open end to form a second encircling edge, (c) inserting said container sequentially into a series of necking dies to form an elongated neck of diameter less than said predetermined diameter at said open end, (d) and after said container is inserted into each necking die and formed therein, ejecting said container from such necking die, and including the step of injecting compressed air into said container through at least some of said necking dies to assist in ejecting said container from such necking dies.

Further objects and advantages of the invention will appear from the following description, taken together with the accompanying drawings.

DETAILED DESCRIPTION OF PREFERRED EMBODIMENT

Figure 1:
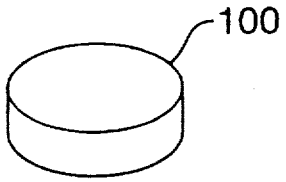
FIG.1 (PRIOR ART)
FIG. 1 is a perspective view of a typical slug used to form a container according to the invention.

Reference is first made to FIG. 1, which shows a typical slug 100 used in the impact extrusion process. Slug 100 is formed of aluminum with suitable alloying materials added, e.g. trace amounts of boron and titanium. The slugs 100 are available from various commercial suppliers.

Figure 2:
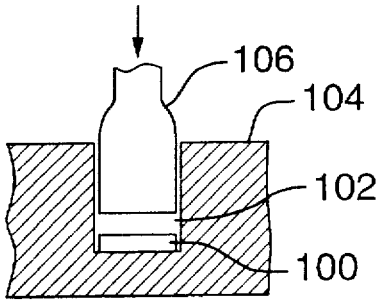
FIG.2 (PRIOR ART)
FIG. 2 is a diagrammatic sectional view showing conventional impact extrusion apparatus used to form an open ended container from the slug of FIG. 1.
Figure 3A:
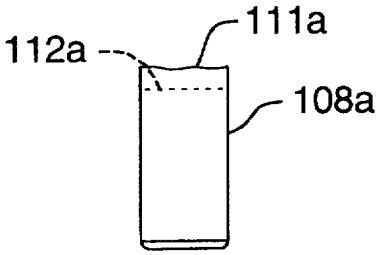
FIGS. 3A and 3B are side views of containers produced by the apparatus of FIG. 2.
Figure 3B:
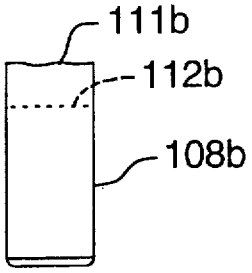

In the impact extrusion process, a slug 100 of suitable dimensions is placed in the cylindrical opening 102 of a hollow die 104 (FIG. 2). A punch 106 impacts the slug at very high speed and pressure, causing the metal of the slug to flow upwardly in the interstitial space defined between the punch outer diameter and the die inner diameter. This forms a thin wall container 108*a*, 108*b* as shown in FIGS. 3A, 3B.

The dimensions of the slug 100 will vary depending on the size container which is to be formed. Typically, for a container having its outer diameter 66 mm, a slug of 65.7 mm diameter is used (just undersized to fit the die), and of thickness varying between about 5.6 mm (to produce a container 135 mm long) to about 8.5 mm (to produce a container 235 mm long). It will be understood that while various dimensions are given throughout this description, all such dimensions are illustrative and other suitable dimensions may be used depending on the container size, wall thickness and length of neck desired.

After the container 108*a*, 108*b* has been formed, it is cleaned, and if desired painted or lacquered. After this process, a neck is formed on the container in what is commonly called a necking process.

In a conventional manufacturing process, the open edge portions 111*a*, 111*b* of the container 108*a*, 108*b* (which edges are usually somewhat uneven after the extrusion process) are trimmed, to provide a straight, smooth edge 112*a* or 112*b*. The trimmed container is then thrust sequentially into a set of forming or necking dies, to form a reduced diameter neck on the container. Standard necking machines for this purpose are sold by various suppliers, e.g. Nussbaum AG of Matzingen, Switzerland as its model EM-38. This machine has 28 stations, at each of which a necking or other operation may be performed.

Figure 4:
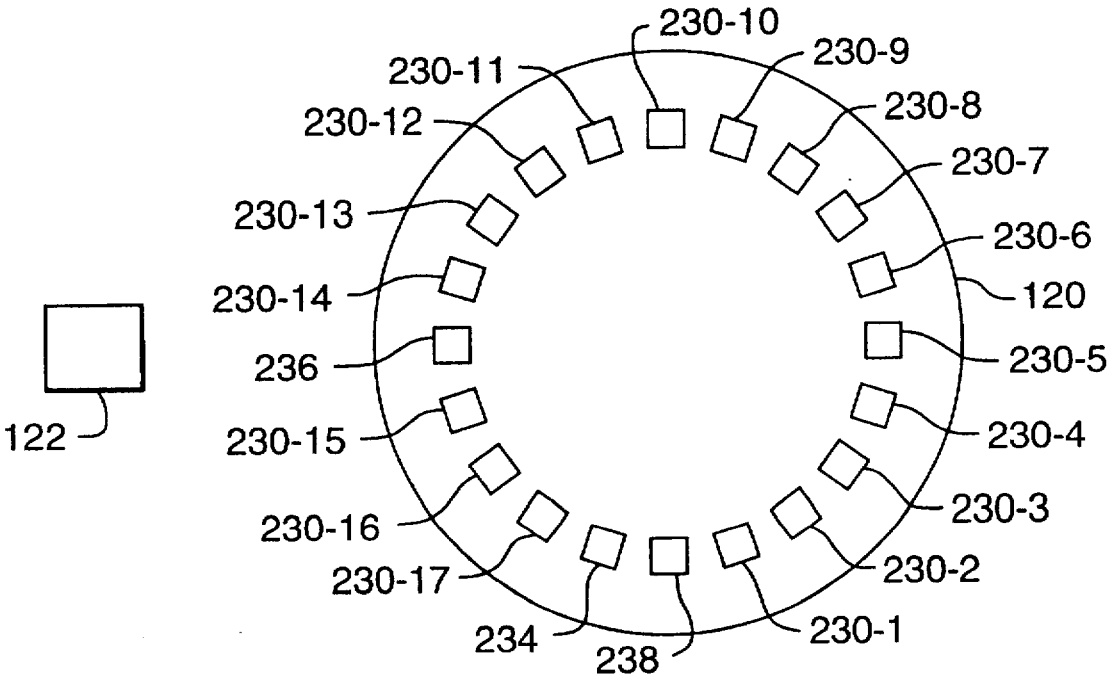
FIG. 4 is a diagrammatic view showing a trimmer, and a necking machine used to form necks in the containers of FIGS. 3A.

FIG. 4 diagrammatically shows a necking machine 120 for performing a method according to the invention. The necking machine 120 is the standard Nussbaum AG machine model EM-38, but much of the tooling on the machine (at its various stations) has been modified or replaced, as will be described. Before containers 108*a*, 108*b* are processed in the necking machine 120, they are first trimmed in a standard trimming machine 122. In trimming machine 122 the container rotates and a knife engages the container to cut off a desired circumferential portion, to provide the smooth, straight cut edge 112*a* or 112*b*.

Because the metal used to form the containers 108*a*, 108*b* is expensive, it is normally desired to trim as little as possible from the end of each container. Conventional practice in the industry is to trim about 8 to 10 mm from the free end of the container. This is usually sufficient to remove the wavy and uneven free edge portions 111*a*, 111*b* produced by the impact extrusion process and to permit normal necking of the containers.

However when the conventional necking method was used in an attempt to produce containers having a long narrow neck, the method worked poorly. It was found that the reject rate caused by split or wavy ends was about 30% to 40% or higher. It was found, as mentioned, that many of the container edges 112*a* would split or wrinkle during the necking process, producing a frayed edge during reduction. The containers would not pass through the complete set of dies in this condition. In addition, even when the containers did pass through the dies, splitting would occur during the thread forming stage. It therefore proved difficult or impossible consistently to produce a container having a long, narrowed neck.

The problem was largely solved by trimming much more than the usual 10 mm from the open end of the container. While this is directly contrary to the normal practice of trimming as little material as possible, it was found that trimming a larger amount Of material before beginning the necking process greatly reduced the extent of wrinkling and splitting of the container end or edge during the reduction process, and during thread forming. Typically at least 20 mm of metal is trimmed from the container end, and preferably 25, or 28, or 30 mm (or more) is trimmed. The precise amount trimmed will depend (as will be explained) on the container dimensions, the length and diameter required for the container neck, and the nature of the material used. It was found that with the "deeper" trimming, used with the other features to be described, the reject rate due to split or wavy ends dropped from 30% to 40% to about 2% to 4%.

The reasons why the increased amount trimmed reduces the extent to which the container edge 112 wrinkles and splits during the necking process are not fully understood. Initially it was believed that the reason was that there may be a difference in hardness at the free end of the container, as compared with the hardness of the container wall further toward the closed end of the container. However tests were conducted on the container 108*a*, 108*b* shown in FIGS. 3A, 3B. Container 108*a* was of "standard" length, i.e. 225 mm (for a trim length of 215 mm) while container 108*b* was extruded to be considerably longer, e.g. 243 mm (again for a trim length of 215 mm).

Figure 5:
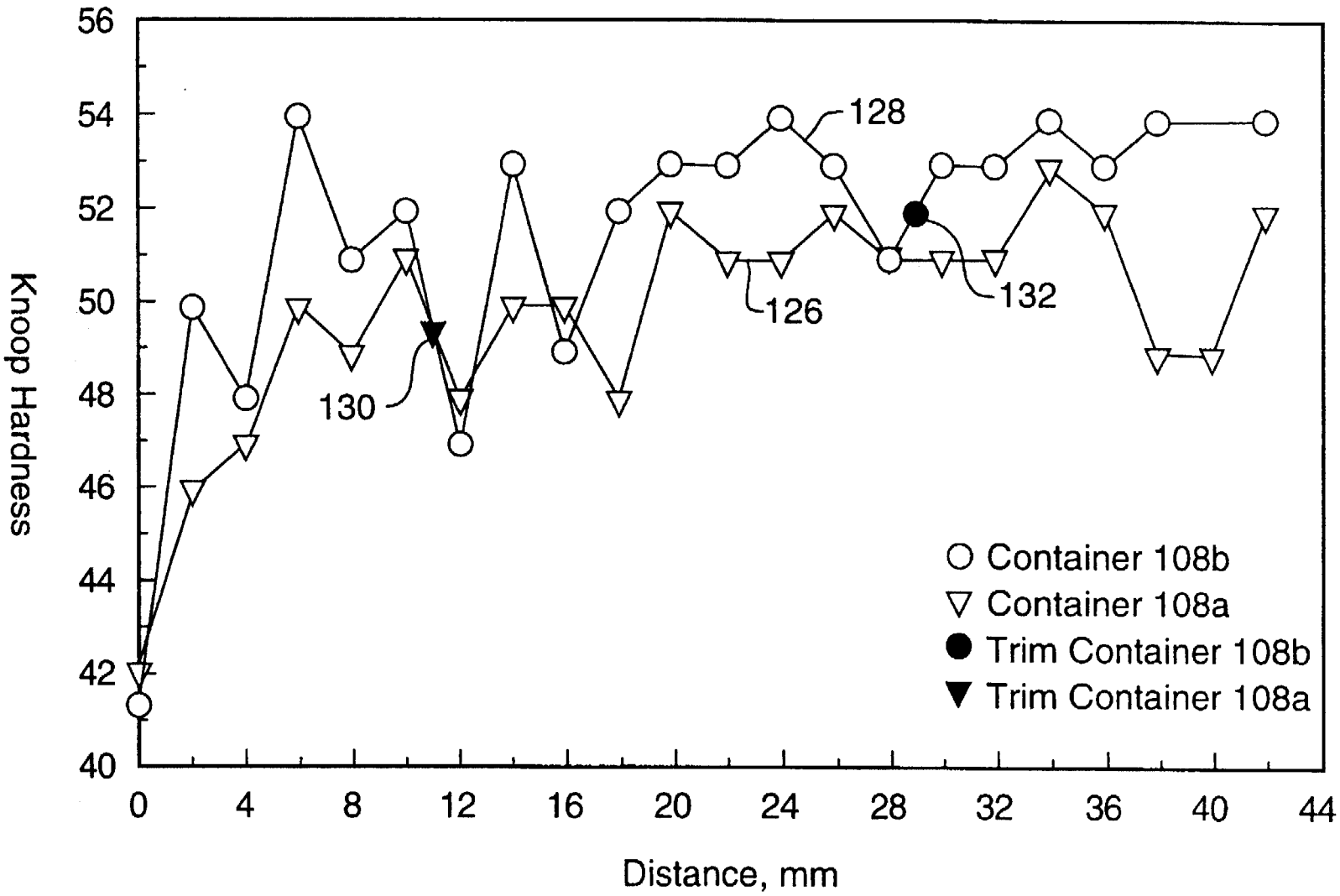
FIG. 5 is a graph showing hardness plotted against distance from the open end of the containers of FIGS. 3A.

Longitudinal sections were taken from the walls of the containers 108*a*, 108*b* and Knoop microhardness measurements were made at the midwalls of the sections every 2 mm beginning at the top of the containers (i.e. edge 111*a*, 111*b*) to the end of the sections, as shown in FIG. 5. In FIG. 5, curve 126 shows the hardness as a function of distance from the open edge 111*a* of the standard height container 108*a*, while curve 128 shows the hardness as a function of distance from the edge 111*b* of longer container 108*b*. The point on curve 126 at which the standard height container 108*a* was trimmed is indicated at 130 (approximately 10 mm from its open edge 111*b*), and the point on curve 128 at which the longer container was trimmed is indicated at 132 (approximately 28 mm from its open edge 111*b*). It will be seen that the hardness at point 132 is greater than that at point 130. As shown, there was a slight increase in the hardness (cold working) of the metal with increasing distance from the open edge 111*a*, 111*b* of each container. Since a material having a higher level of cold working hardness is less formable, therefore the degree of hardness or cold working does not account for the difference in behaviour observed when a larger amount of metal is trimmed.

Figure 6:
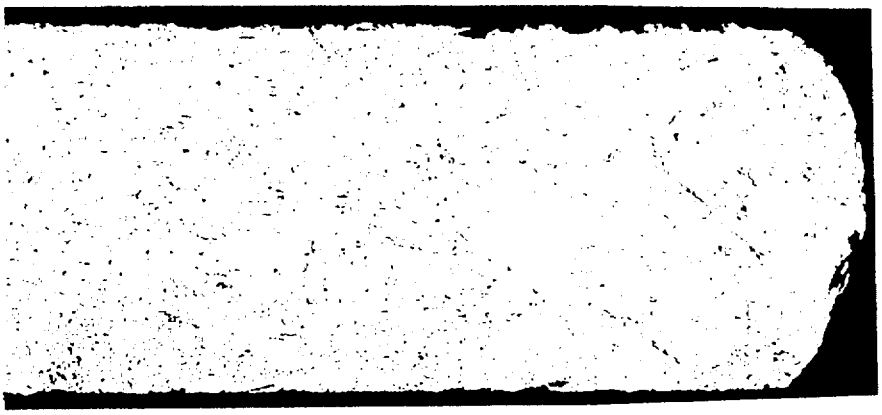
FIG. 6 is a photomicrograph showing metal structure at the free edge of the container of FIG. 3B.
Figure 7:
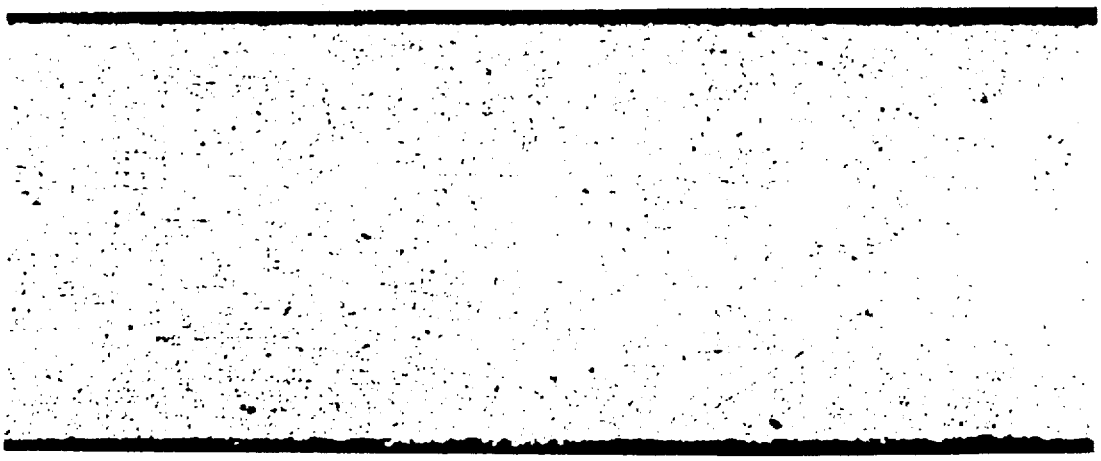
FIG. 7 is a photomicrograph showing metal structure 8 to 10 mm from the free edge of the FIG. 3B container.

Next, photomicrographs were taken of the sections taken from container 108*b*. FIG. 6 is a photomicrograph of a sample from container 108*b* (100 times magnification) at the open edge 111*b* of the container. FIG. 7 is a similar photomicrograph taken about 10 mm from the open edge 111*b* of the same container 108*b*, while FIG. 8 is a photomicrograph taken about 28 mm from the open edge 111*b* of the container 108*b*.

It will be seen in FIG. 6 that adjacent the open edge 111*a*, there are numerous precipitates 134 in the metal which form nearly continuous lines 136 on the photomicrographs. It is believed that these abundant precipitates, and perhaps a higher degree of irregularity in the metal structure, can create weaknesses in the microstructure of the metal, resulting in poor formability in the dies.

In FIG. 7 (showing where standard trimming in effect occurs), it will be seen that the precipitates 134 are still abundant, although slightly less so than in FIG. 6, and that they still form nearly continuous lines 136.

Figure 8:
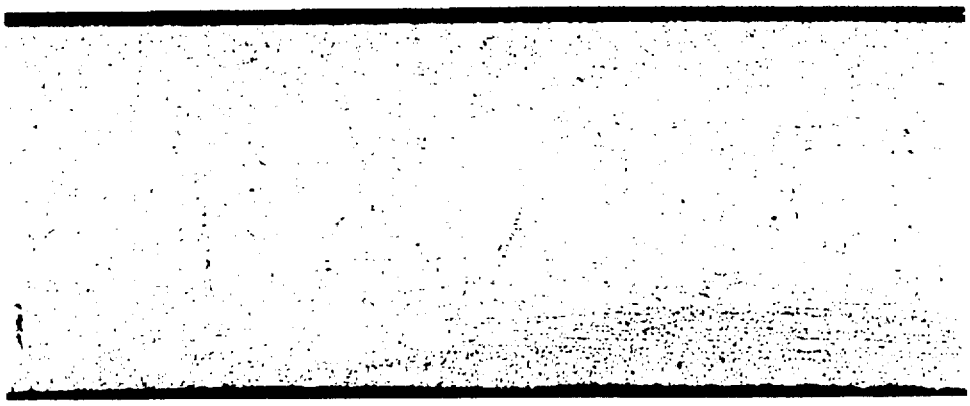
FIG. 8 is a photomicrograph showing metal structure approximately 30 mm from the free edge of the FIG. 3B container.

In FIG. 8, about 28 mm from the edge 111*a* of the container 108*b* there are fewer precipitates than in FIG. 7, and the continuous lines formed by them are less marked. It is believed that the reduction in precipitates or contaminants is an important reason for the improved formability.

It is believed that the contaminants or impurities occur in the slugs during their forming and preparation. In the production of slugs, aluminum with appropriate additives is liquified and fed down a trough through rollers in a type of continuous casting process, to form aluminum strips. The strips when cast may initially be 4 inches wide and 2 inches high but when they are rolled, they are reduced greatly in thickness, to between 4 and 12 mm depending on the thickness of slug required. They are then usually rolled for storage, and later unrolled and stamped to form the slugs, although they can also go directly from forming to stamping. During this manufacturing process, the exterior surfaces of the aluminum are exposed to the rollers and to the air and may accumulate impurities.

In addition, after the slugs are stamped, they are normally pre-tumbled by their manufacturer to roughen their surfaces, so that lubricant will adhere evenly to them. The pre-tumbling creates major surface irregularities. The slugs are then again tumbled (usually by the container manufacturer) in grease (e.g. zinc stearate) to coat them with a lubricant which permits the material to flow through the impact extrusion tools without scratching the tools. Without the lubricant, the aluminum (which is very abrasive) tends to scratch the tools. The lubricant may add further impurities to the surface of the aluminum slug.

It is known that when a slug is impacted by an impact extrusion punch, the first metal to flow comes from the impacted side of the slug and from the exterior circumference of the slug. It therefore appears that the contaminants on the surfaces, and perhaps some surface irregularities, are the first to move from the slug and thereby position themselves at or near the leading edge 111*a*, 111*b* of the extruded container. It appears that this is the reason why the contaminant levels reduce in a direction away from the open or leading edge 111*a*, 111*b* of the extruded container, and why a deeper trim than normal permits formation of a long, narrow neck without a high reject rate. In effect the deeper trim exposes metal at the open edge which is substantially more formable than that exposed by a normal (less deep) trim.

Figure 9:
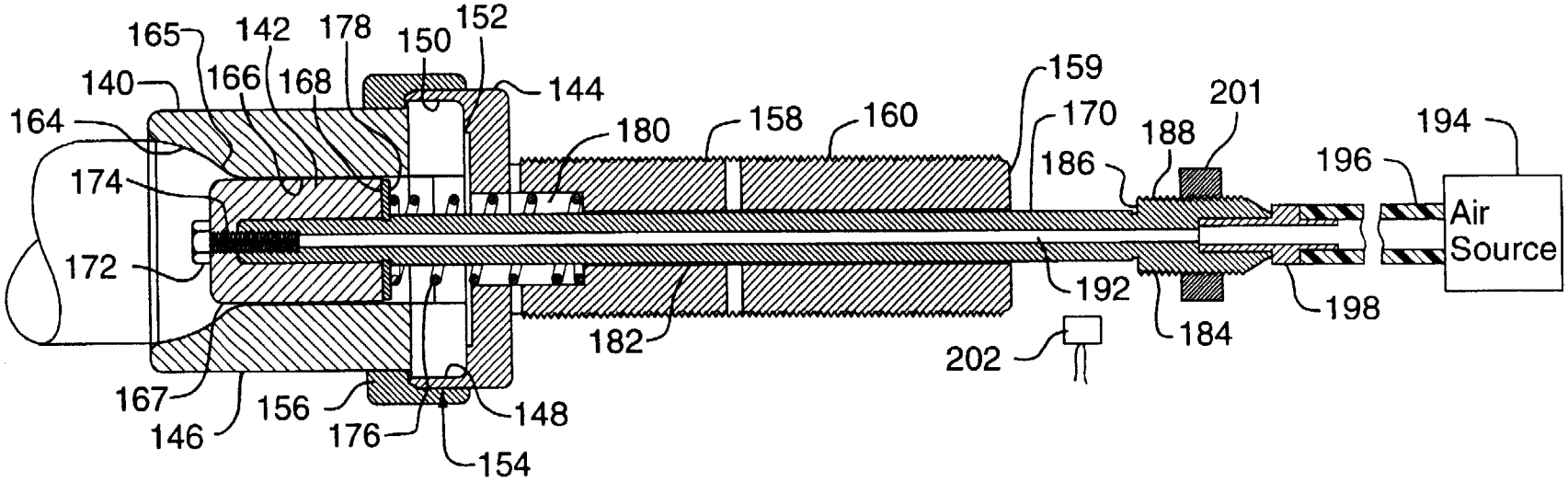
FIG. 9 is a side view, partly in section, showing outer and inner die parts mounted on a die holder for necking a container, and showing a container in position between the die parts.

The method of making a long, narrow neck container will next be described. Reference is made to FIG. 9, which shows an outer die 140 and an internal guide 142 in position on a die holder 144. As shown, the outer die 140 includes a cylindrical outer surface 146 having an enlarged lip 148 at its rear end. The lip 148 is received in an opening 150 in die holder 144, with a rear clearance space 152 to accommodate dirt particles and the like. Die holder 144 has an outer thread 154 which receives a die locking nut 156 to hold the outer die 140 in position. Die holder 144 also includes a rear stem 158 having a rear surface 159 and which has an outer thread 160 to permit it to be locked into a necking machine such as the Nussbaum AG necking machine referred to above.

The outer die 140 also has an inwardly curving surface or lead profile 164. Lead profile 164 blends smoothly into a forming radius or surface 165, which is the surface that actually works the metal of the container. Forming radius 165 blends smoothly into a generally cylindrical inner surface 166 (which in fact tapers slightly outwardly toward the rear of the outer die).

The internal guide 142 has an outer cylindrical surface 167 which is positioned within the cylindrical surface 166 with a small annular space between them, sufficient to accommodate the metal of the container end with very narrow clearances (to limit and control undesired waviness and splitting of the metal). The internal guide 142 includes at its rear end a lip 168 which serves as a stop for the free edge of the container.

Figure 10:
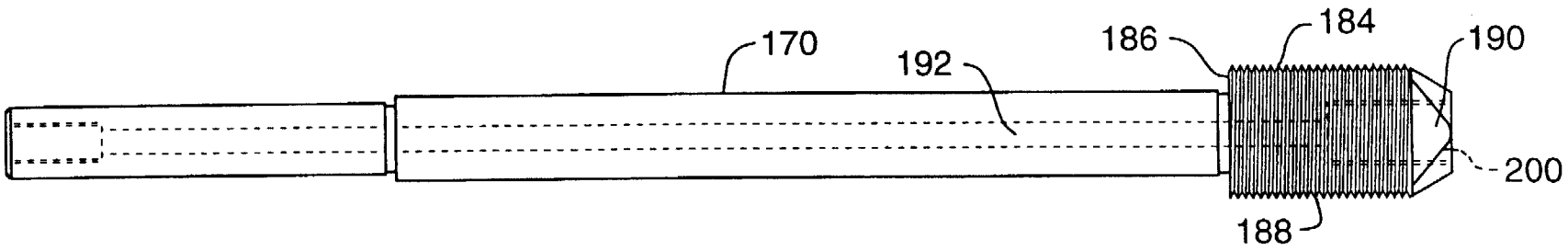
FIG. 10 is a side view of a guide shaft used in the FIG. 7 apparatus.
Figure 11:
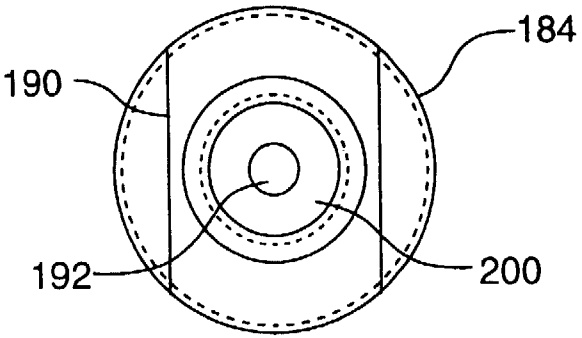
FIG. 11 is an end view of the guide shaft of FIG. 10.

The internal guide 142 is mounted on a guide shaft 170 (also shown in FIGS. 10, 11). Shaft 170 extends through the center of internal guide 142 and is held thereto by a locking bolt 172 accommodated in an internal threaded recess 174 in the front end of guide shaft 170.

A coil spring 176 encircles the guide shaft 170 behind the internal guide 142 and abuts against the rear end 178 of the inner guide. The spring 176 is received in a recess 180 in die holder 144.

Internal guide shaft 170 extends through recess 180 and through an axial opening 182 in the rear stem 158 of die holder 144 and has an enlarged end 184. End 184 has a first surface 186, a threaded outer surface 188, and a rear flat 190 (FIG. 11) to permit gripping of end 186 by a wrench (not shown). An axial opening 192 extends entirely through the guide shaft 170, from enlarged end 184 and through the locking bolt 172. The opening 192 permits compressed air from a source 194 to be introduced via flexible hose 196 into the container to help eject the container, as will be described. Hose 196 is connected to guide shaft 184 by a fitting 198 threaded into opening 200 in the enlarged end 184.

In use, before the container is introduced into the die 140 of FIG. 9, the guide shaft 170 normally assumes a position in which the front surface 186 of enlarged end 184 contacts the rear surface 159 of the die holder stem 158, and the enlarged rear lip 168 of the internal guide 142 is positioned adjacent the position where the outer die inner surfaces 165, 166 join. When a container 108*b* is thrust into the die 140 by the necking machine, the free edge of the container contacts lead surface profile 166 and is guided into the forming radius 165, beginning the forming process. Once through the forming radius, the free edge contacts lip 168 and forces the internal guide 142 rearwardly (to the right as drawn in FIG. 9), against the pressure of spring 176. As the container is forced against the forming radius 165, the metal of the open end of the container is deformed thus performing one step in the necking process. As the internal guide 142 is forced rearwardly or to the right as drawn in FIG. 9, the metal ring 201 mounted on the enlarged end 184 moves to the right, away from a proximity switch 202 which is mounted on the necking machine. If the guide shaft sticks and fails to return to its original position, the switch will detect the absence of a target and the machine will shut off.

After the container has been partially formed in die 140, it must be ejected so that it can move to the next forming station on the necking machine. Because the clearances between the metal of the container and internal guide 142 and the outer die 140 are so small at least in the initial die stations (as will be explained), it is found that the force of spring 176 is not sufficient to eject the container in at least the first few forming stations. Therefore, in at least the first three or four forming stations, compressed air from source 194 (typically at about 100 psi pressure) helps to eject the container during the ejection step. It is found that without the compressed air, the containers may stick in the dies and are ruined when the machine tries to move them to the next forming station. In addition the air helps to cool the containers, dies and guides, removing heat added by the aggressive forming (the necking machine typically forms about 100 containers per minute).

Figure 12:
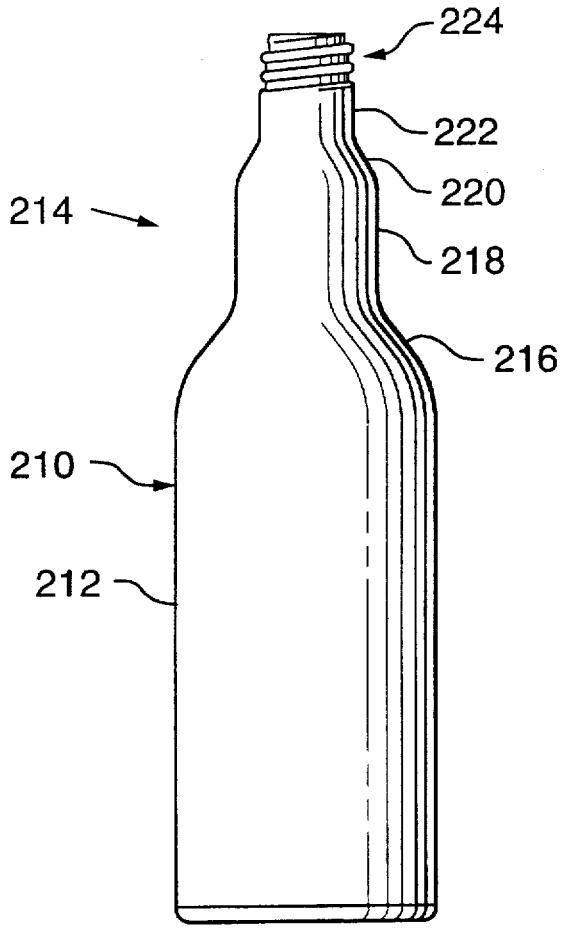
FIG. 12 is a side view, dimensioned, of a finished threaded container formed by the method of the invention.
Figure 13:
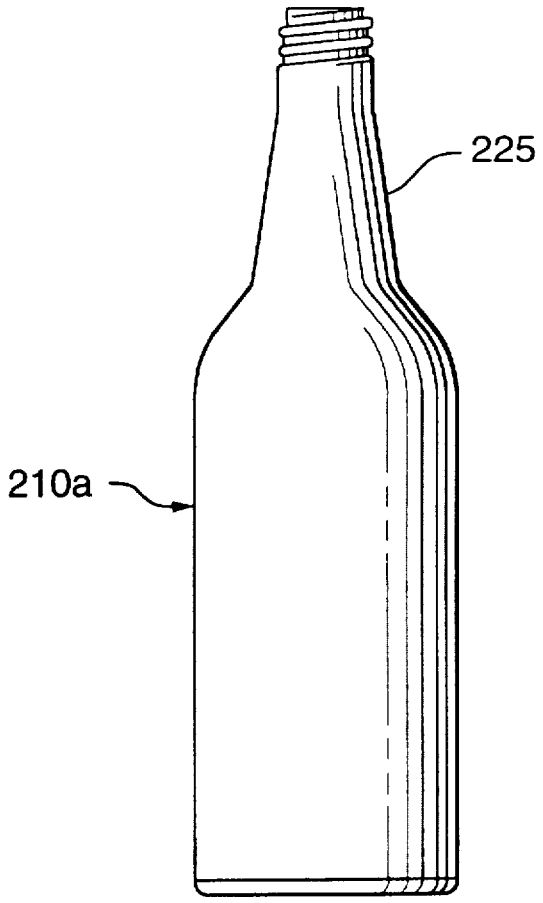
FIG. 13 is a side view, dimensioned, of a modified threaded container formed by the method of the invention.
Figure 14:
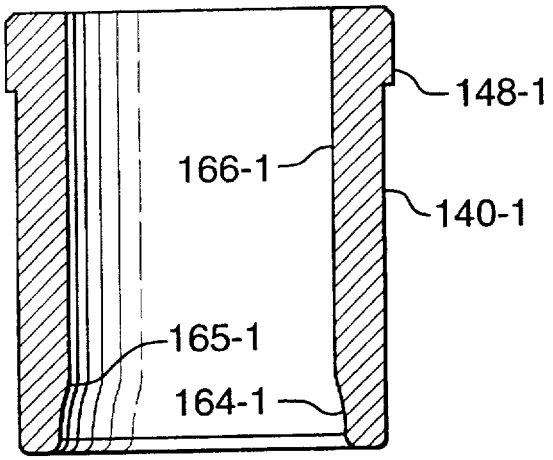
FIGS. 14 to 21 are each side sectional views of respective progressive outer dies used with the apparatus of FIG. 9.
Figure 15:
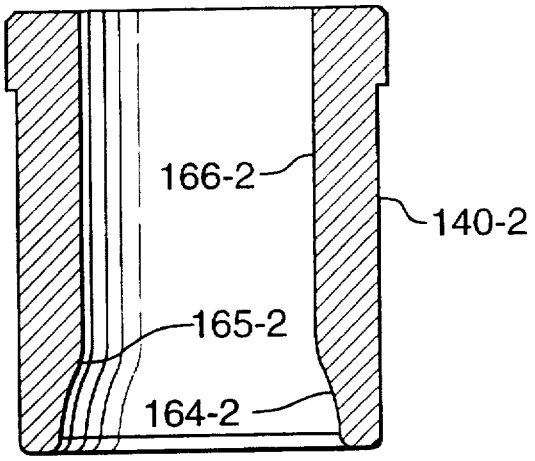
Figure 16:
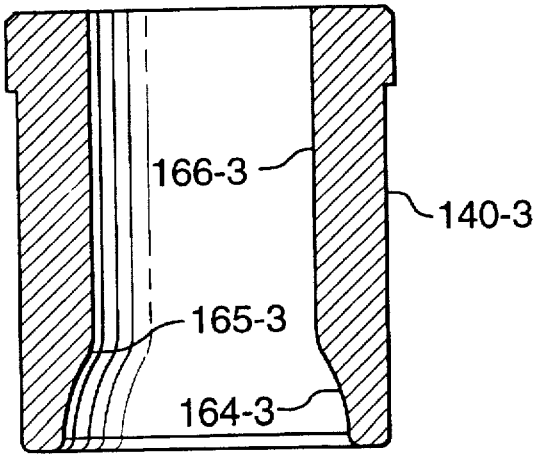
Figure 17:
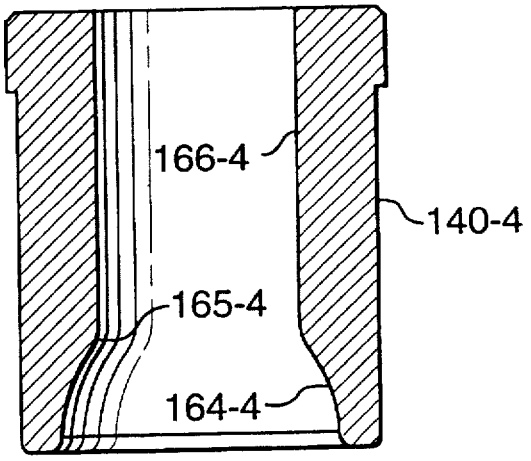
Figure 18:
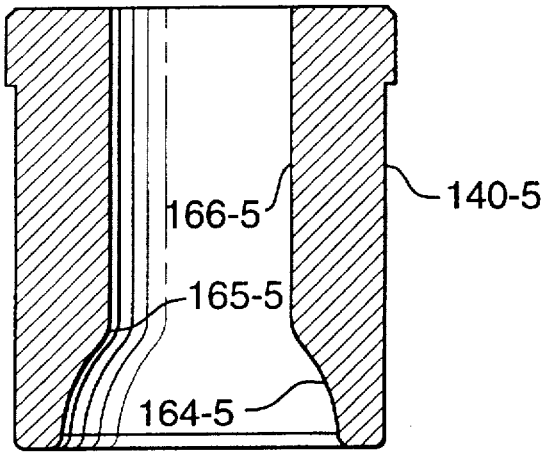
Figure 19:
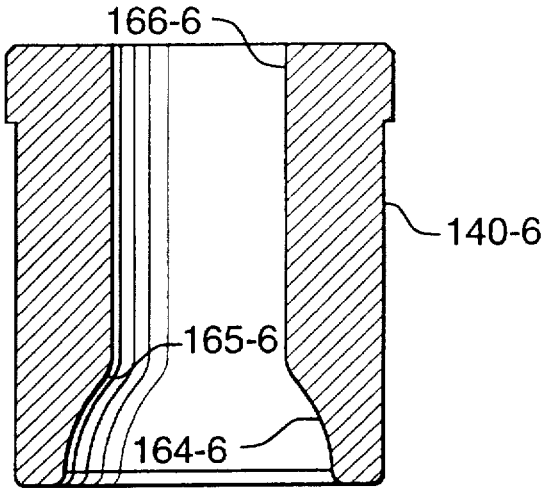
Figure 20:
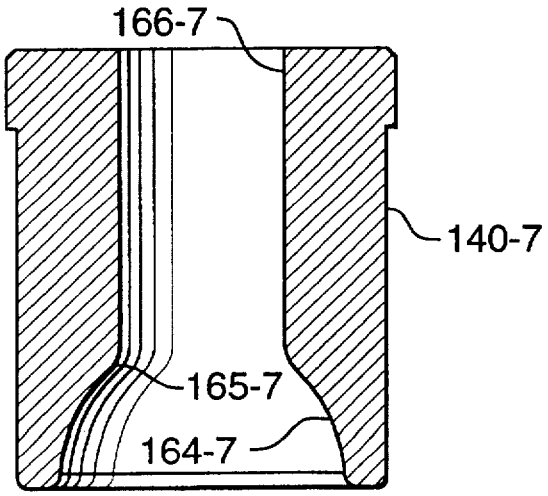
Figure 21:
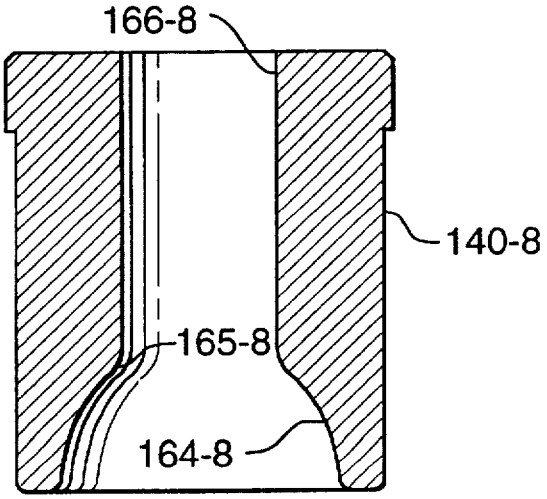
Figure 22:
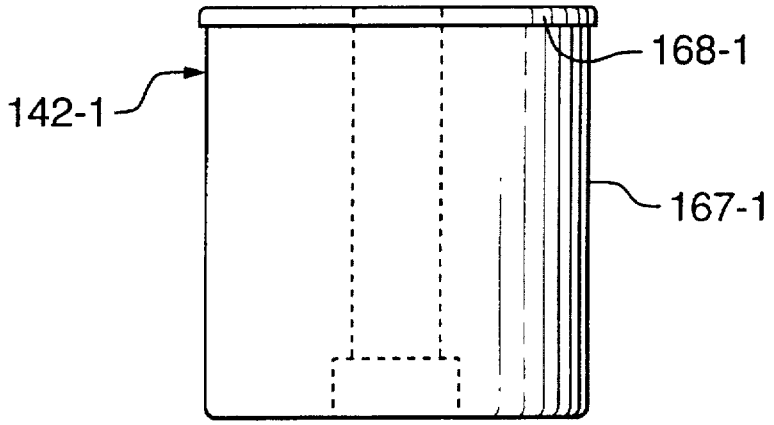
FIGS. 22 to 29 are side sectional views of progressive internal guides used respectively with the external dies of FIGS. 14 to 21.
Figure 23:
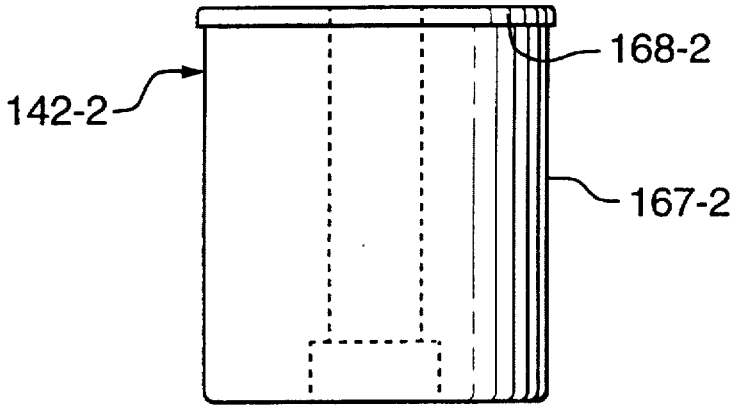
Figure 24:
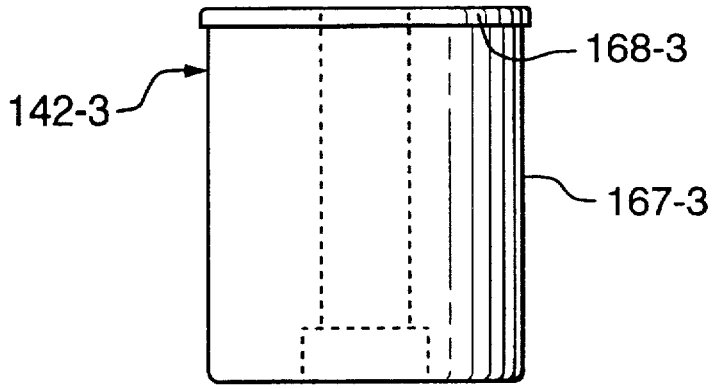
Figure 25:
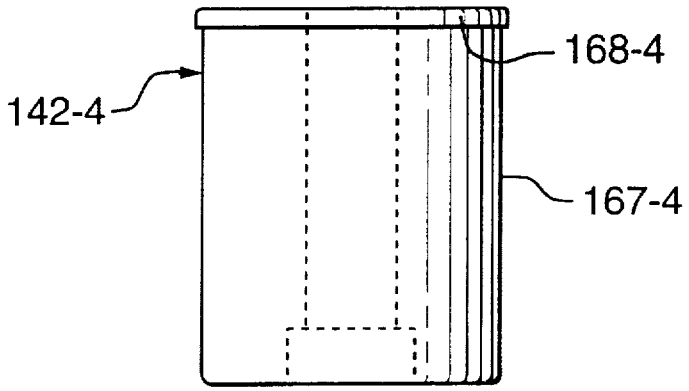
Figure 26:
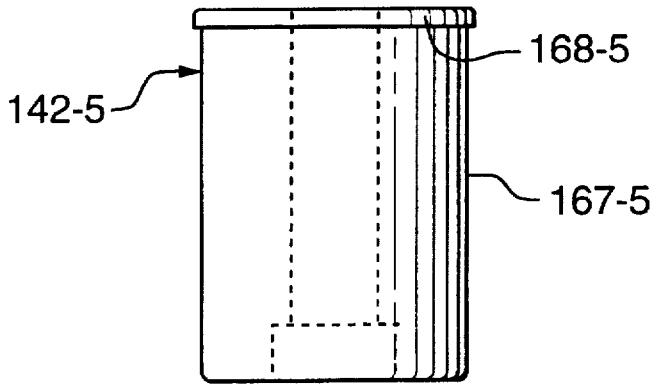
Figure 27:
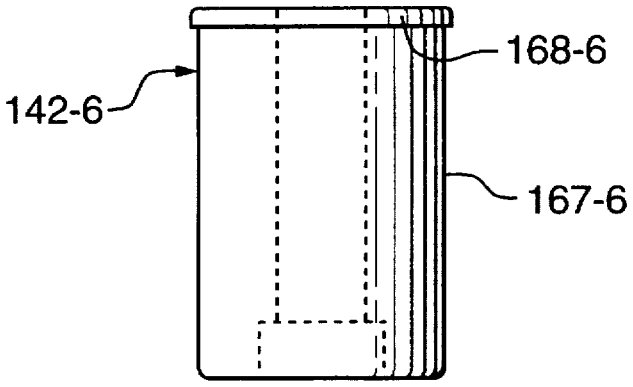
Figure 28:
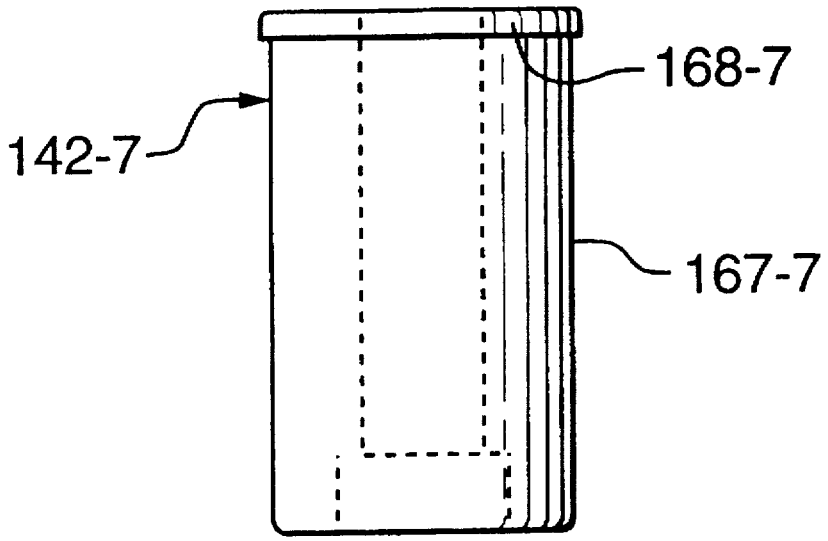
Figure 29:
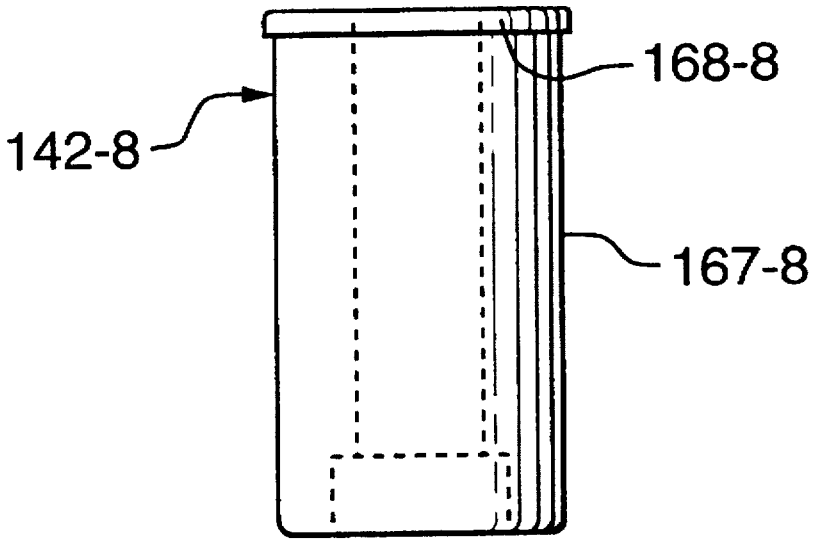
Figure 30:
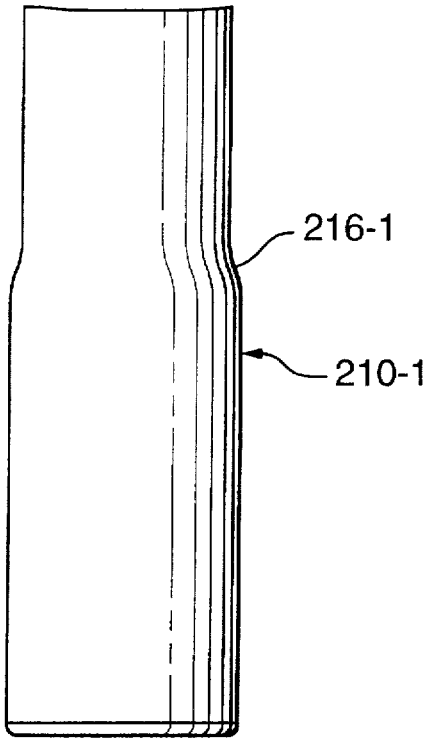
FIGS. 30 to 47 are side views of a container as it is processed through the respective stations to produce a narrowed elongated neck.
Figure 31:
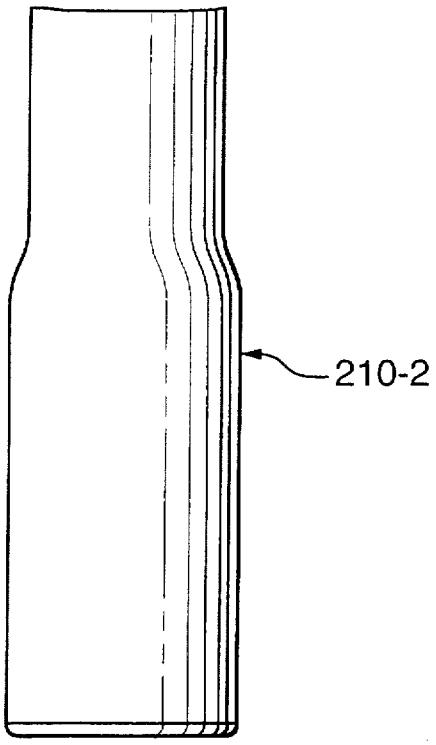
Figure 32:
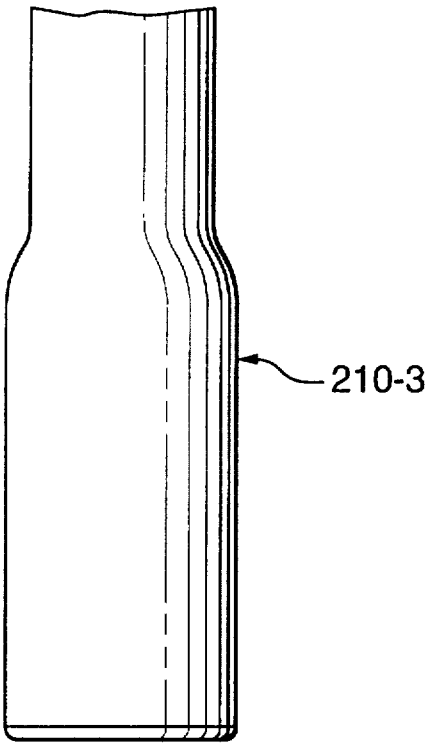
Figure 33:
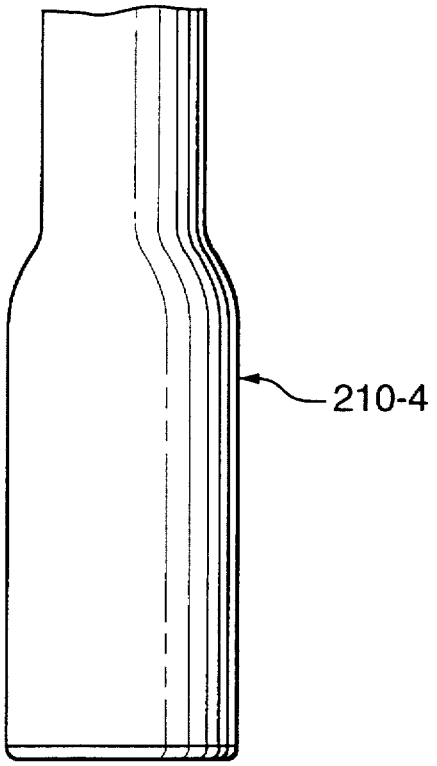
Figure 34:
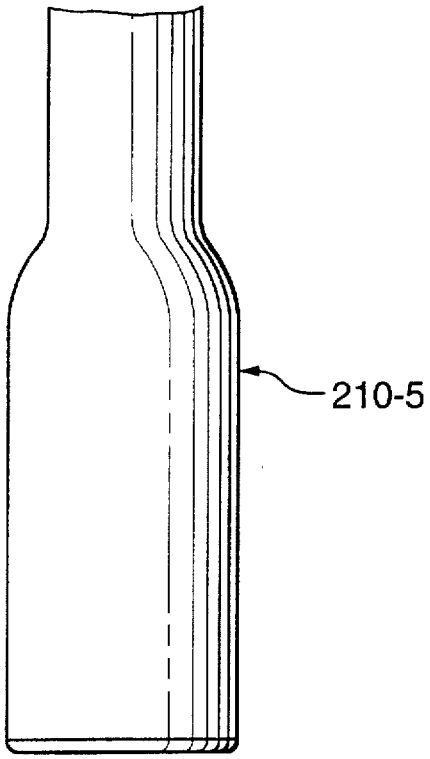
Figure 35:
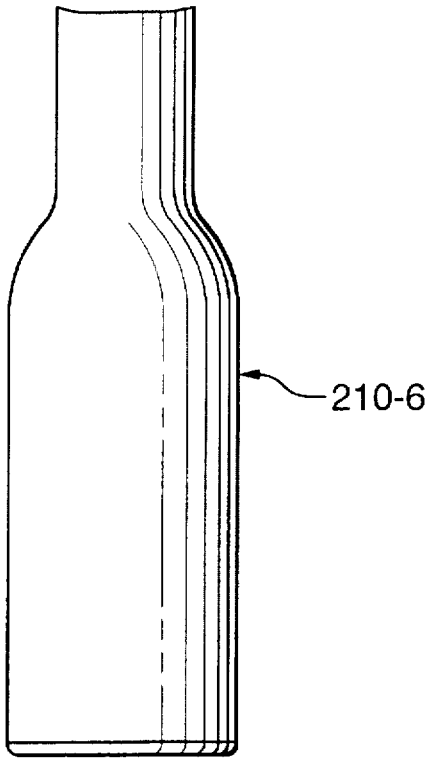
Figure 36:
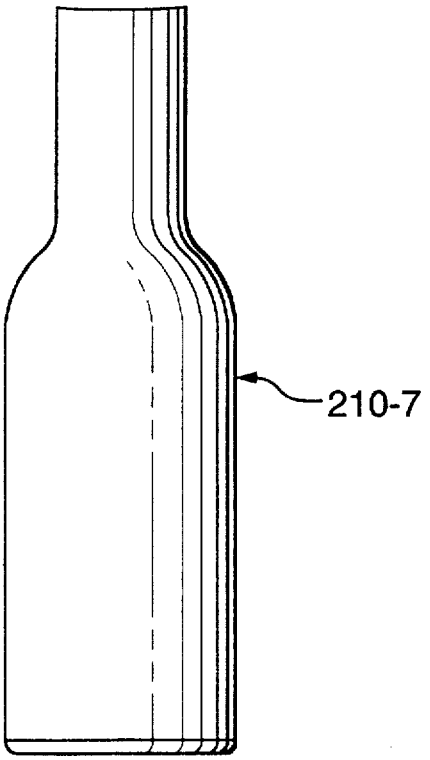
Figure 37:
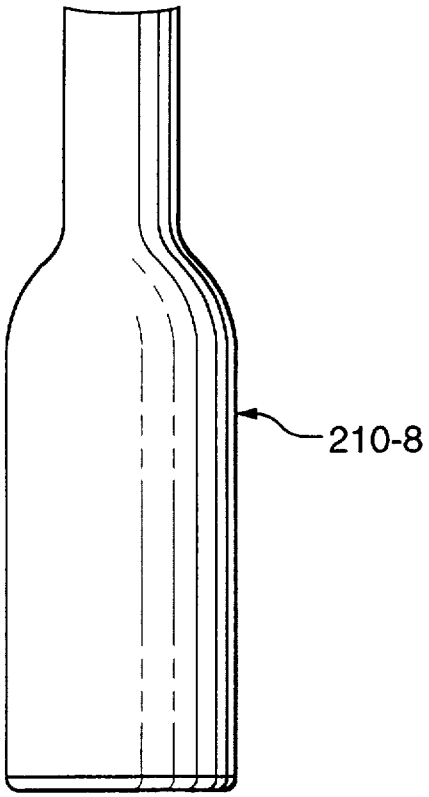
Figure 38:
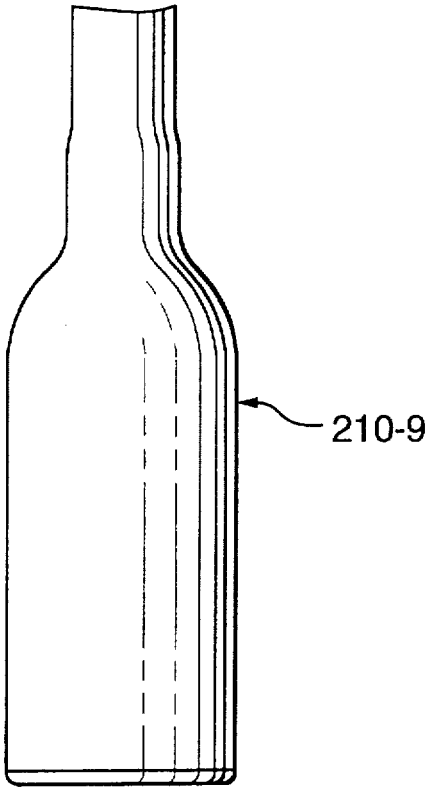
Figure 39:
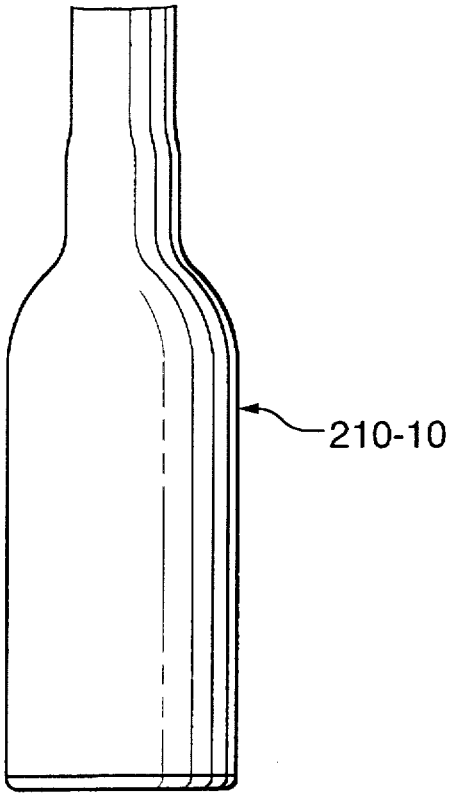
Figure 40:
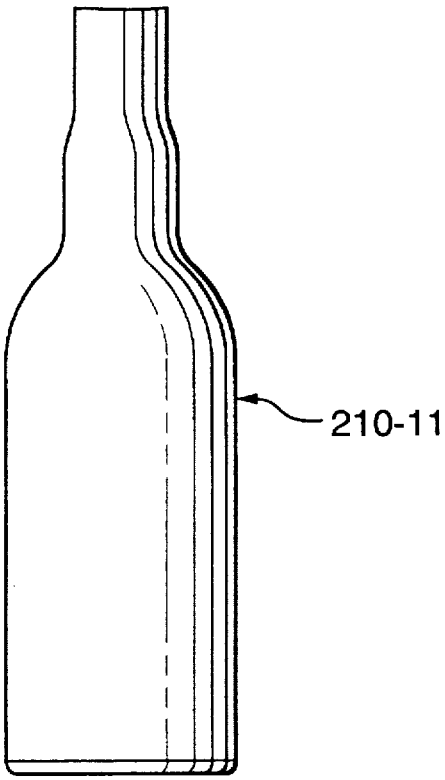
Figure 41:
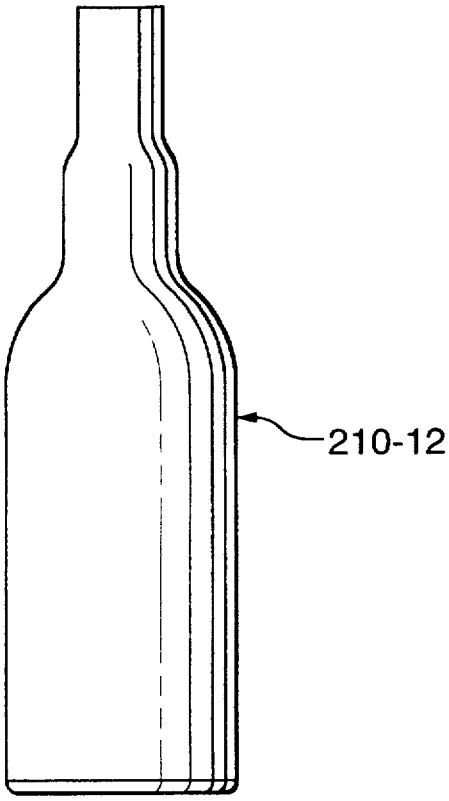
Figure 42:
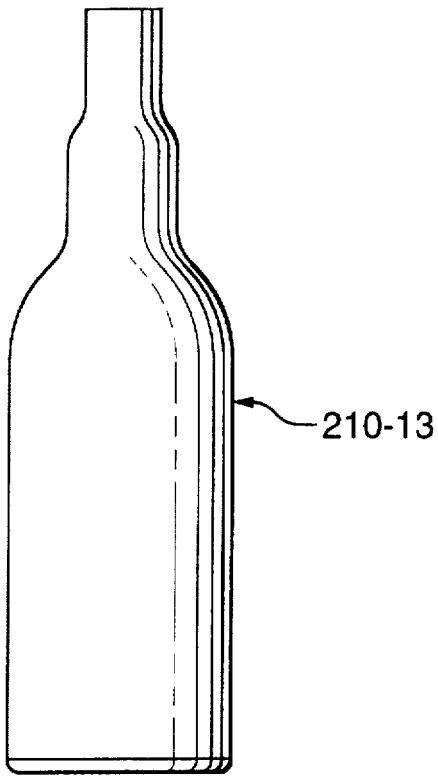
Figure 43:
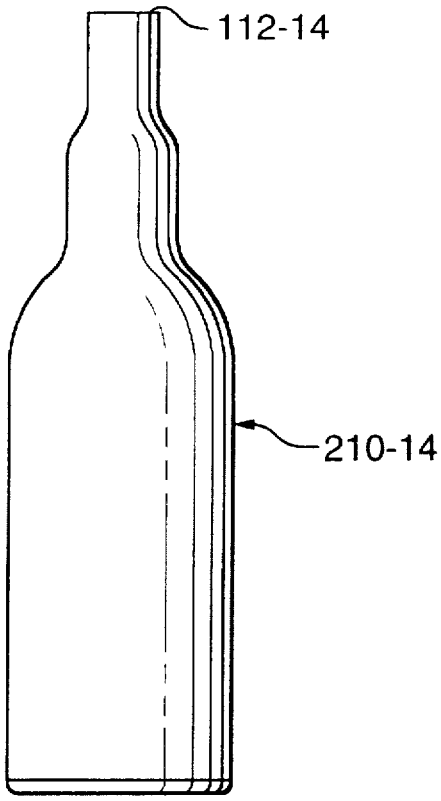

A typical container having a long, narrow neck which may be formed by the method of the invention is shown at 210 in FIG. 12. Container 210 has the usual cylindrical body 212 and is (in the illustrative embodiment described) 228.3 mm long, of which the neck 214 is in total 102.5771 mm long. The neck 214 includes a first curved portion 216, a cylindrical narrowed portion 218 (diameter 34.0 mm) extending from curved portion 216, a second curved portion 220 extending from portion 218, a second cylindrical narrowed portion 222 extending from curved portion 220 (diameter 22.0 mm), and a thread 224 at the end of portion 222. Other profiles can of course be made, e.g. as shown at 210*a* in FIG. 13, where portions 216, 218, 220 are formed as a single straight, conical taper 225.

FIGS. 14 to 21 are dimensioned drawings of the outer dies 140-1 to 140-8 used in the first eight forming or necking stations 230-1 to 230-8 (FIG. 4) of a necking machine. 120 for producing containers of the kind shown in FIG. 12. Reference numerals followed by the suffix "–1" to "–8" indicate parts corresponding to those of FIGS. 9 and 10 and/or located at the first eight forming stations. It will be seen that the inner curved surfaces 164-1 to 164-8 of the outer dies become progressively more arcuate, and longer, as the dies progress from stations 230-1 to 230-8 (as the neck of the container is progressively narrowed).

FIGS. 22 to 29 show the internal guides 142-1 to 142-8 used with the outer dies 140-1 to 140-8 respectively. The internal guides are all of the same general shape, but their particular dimensions vary as shown depending on the die with which they are used.

FIGS. 30 to 37 show the container 210-1 to 210-8 after it has passed through each of the first eight stations (containing the dies and internal guides shown in FIGS. 14 to 29). The length of the container is also shown. It will be seen by comparing FIGS. 30 and 12 that at the first necking station 230-1, the neck has been reduced in diameter from 66.0 to 60.26 mm and the container has been reduced slightly in length from 215 to 213.3 mm. The reason for the shortening in length is that the aggressive curvature 216-1 of the neck has absorbed what would otherwise be an increase in length. However it will be seen from FIGS. 31 to 37 that at each successive necking station, as the neck becomes smaller in diameter, the length of the container (specifically of the neck portion) increases.

To allow for the changes in container length and also for the various dies used, the length of the guide shaft 170 is made shorter at each successive station. In the embodiment with the dimensions shown, the guide shaft 170 lengths at the first eight stations were:

| Station | Length L (total length of guide shaft 170 (mm) | Length Q (length of portion supporting internal guide 142 (mm) |
|---|---|---|
| 230-1 | 319.75 | 56.27 |
| 230-2 | 315.55 | 54.13 |
| 230-3 | 312.26 | 52.78 |
| 230-4 | 309.67 | 51.55 |
| 230-5 | 307.87 | 51.45 |
| 230-6 | 306.34 | 51.52 |
| 230-7 | 304.12 | 51.40 |
| 230-8 | 303.51 | 52.48 |

It is also noted that the wall thickness of the container neck increases during the necking process. Therefore the thickness of the annular space between outer dies 140 and internal guide 142 is increased at each necking station. The thickness of each annular space can be seen from the dimensions in the drawings. For example at the first station 230-1 the internal diameter of surface 166-1 in die 140-1 is 60.2619 mm, while the external diameter of corresponding guide 142-1 is 59.30 mm, leaving an annular space between them of 0.9619 mm. At station 230-8 the internal diameter of surface 166-8 is 34.0 mm and the external diameter of guide 142-8 is 32.62 mm, leaving an annular space between them of 1.38 mm, which is considerably thicker.

It is also noted that the annular space between each die and its internal guide is sufficiently wide to accommodate not only the wall thickness of the container at that stage, but also a clearance. In many common necking processes the clearance is between 0.11 and 0.15 mm, but with the process of the invention the clearance has been reduced to 0.04 to 0.06 mm (preferably 0.04 mm). (The clearance of 0.04 mm is a total clearance, i.e. 0.02 mm clearance from each surface of the container neck wall.)

The very small clearance helps to control the flow of material and prevent splitting and wrinkling, and in addition the tight clearance causes "ironing" of the material to occur during the necking steps. During the ironing, the metal surface is smoothed and actually reformed as it lengthens. However because of the friction created by the narrow clearances, the compressed air from source 194 is needed as mentioned to help eject the containers, at least in the-first few stations.

With the container profile shown in FIG. 12, the most aggressive forming occurs in stations 230-1 to 230-8, where the neck is rapidly narrowed from 66 to 34 mm. In the next set of forming stations 230-9 to 230-14, the neck is further narrowed to 22 mm. This is a lesser degree of necking and therefore compressed air ejection assist is not normally needed. The container as it passes through stations 230-9 to 230-14 is shown in FIGS. 38 to 43. These stations 230-9 through 23-14 contain dies and internal guides as previously described, with appropriate dimensions.

It is found that even with the steps described above, the integrity of the cut edge 112*b* of the container cannot be preserved throughout the entire necking process. Even with removing a much larger than normal portion of the open end of the container before beginning the necking process, to reduce impurities at the free end, and even with the very tight clearances used, the cut edge of the container tended to split, wrinkle and become uneven to some extent during the reduction process. The uneven edge is indicated at 112-14 in FIG. 43. This caused fractures to occur when applying the thread in the threading station 34 (FIG. 4).

Therefore a mid-station trimmer 236 is added, as shown in FIG. 4. The trimmer 236 is a conventional trimmer, like trimmer 122, and simply cuts off a small section of the free end of the container between forming stations 230-14 and 230-15, to eliminate the edge which may contain splits and wrinkles. It is normally necessary to remove only about 3 mm for this purpose.

Figure 44:
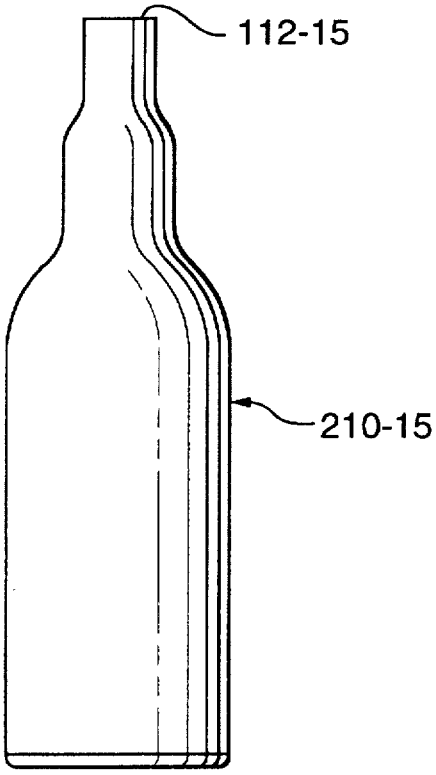
Figure 45:
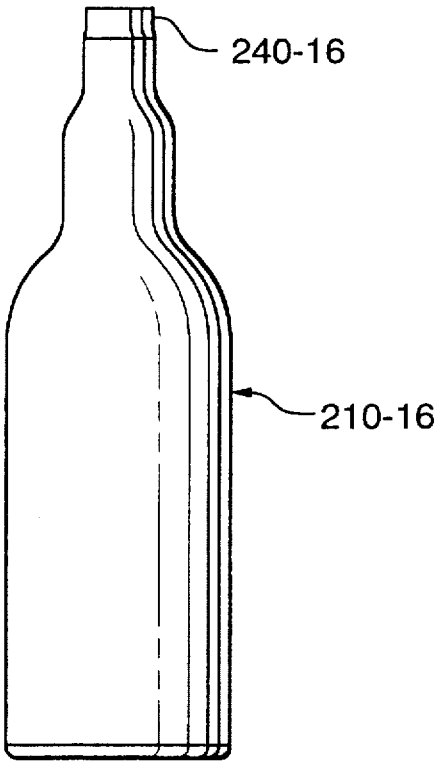
Figure 46:
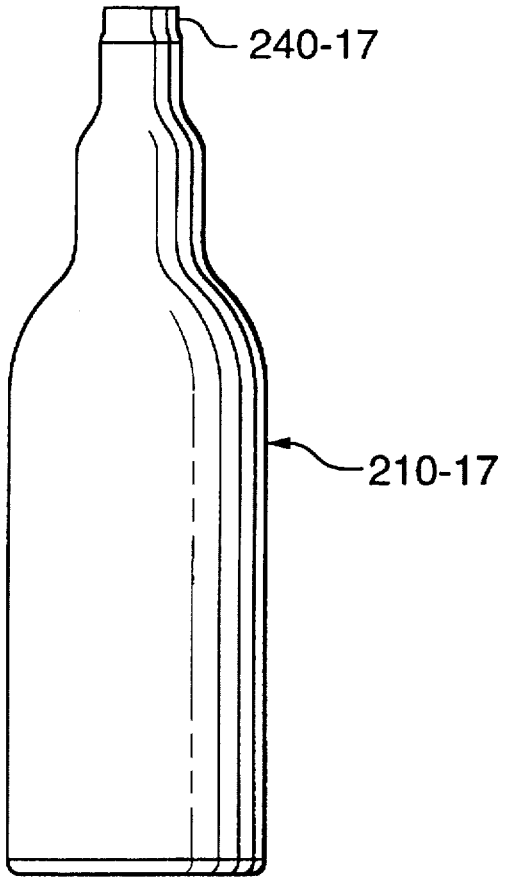
Figure 47:
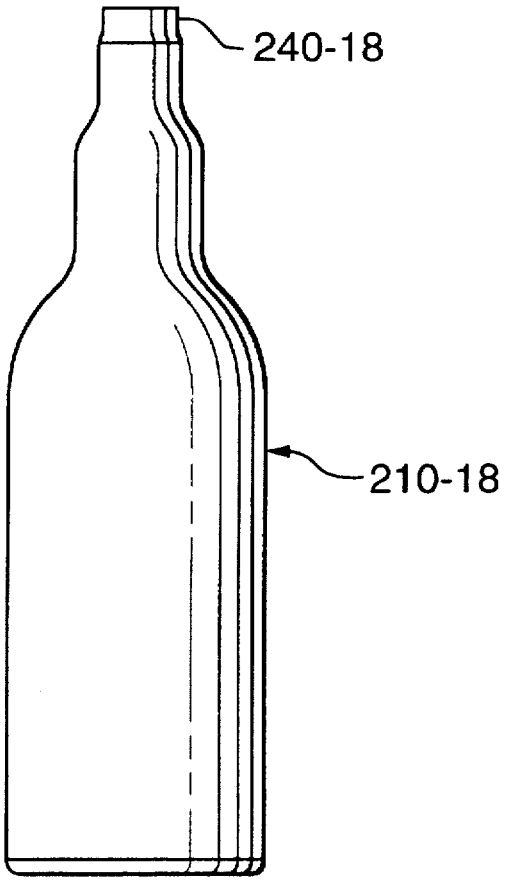

After the container leaves the mid-station trimmer 236, it has a cut edge 112-15 which is straight and smooth (FIG. 44). The container then passes through three additional (and conventional) forming stations 230-16 to 230-18 which reduce the top of the neck to a shape suitable for a thread. The shaped top portion is shown at 240-16 to 240-18.

The container then moves to the threading station 234, where the thread 224 (FIG. 12) is applied. Despite the aggressiveness of the thread forming, it is found as mentioned that very little splitting occurs, and that the reject rate due to splitting or wrinkling is now only 2% to 4%.

After threading, the container moves to a final trimming station 238 where its open edge is again trimmed, to regulate the height of the container. This final trimming is conventional.

While specific dimensions have been given by way of example, it will be understood as previously mentioned that the dimensions may be changed depending on the dimensions of the particular container and neck being formed, and on the extent of impurities present in the slug used to form the container. For example, instead of pre-tumbling the slug (which tends to create large scale surface irregularities which may increase the precipitates found in the open end of the container), the slug can be sandblasted (to create a more controlled textured surface) and lubricant then applied. With the sandblasting, the lubricant adheres more evenly, with no need for the harsh pre-tumbling, and it may then be possible to cut off less from the open end of the container in order to reach a metal region which produces better formability. In addition, if more care is taken in the production of slugs, so that they pick up fewer contaminants from the air, the rollers, and generally from handling during their production, then a less deep trim will be needed. However the initial trim will normally always be deeper than that needed simply to achieve a straight, smooth edge.

The deep trim is particularly useful when the reduction in the neck diameter must be large (e.g. as here, from 66 mm to 22 mm, and then to 19.45 mm, or by more than 44 mm, i.e. two thirds) and where the neck is to be elongated. (For automotive applications preferably the neck is at least 75 mm long, and desirably at least 100 mm long.) If the neck reduction were smaller, again a less deep trim would be needed.

While preferred embodiments of the invention have been described, it will be appreciated that various changes may be made within the spirit of the invention and all such changes are intended to be included within the scope of the attached claims.

I claim:

1. A method of forming a metal container of predetermined diameter and having an elongated, narrowed neck, said method comprising:

(a) impact extruding a slug to form a container having an open end, said open end being defined by an encircling first edge, (b) trimming a portion from the length of said container at said open end to define a second encircling edge, said portion being at least 20 mm long so that the metal of said container at said second edge comprises metal which is substantially more formable than the metal of said container at said first edge, (c) inserting said container sequentially into a series of necking dies to form said elongated, narrowed neck at said open end.

2. A method according to claim 1 wherein said portion which is trimmed is at least 25 mm long.

3. A method according to claim 2 wherein said portion which is trimmed is at least 30 mm long.

4. A method according to any of claims 2 or 3 wherein said elongated, narrowed neck has an open end, and including the step, after forming said elongated, narrowed neck, of forming a thread on said neck adjacent said open end thereof.

5. A method according to any of claims 2 or 3 wherein said neck after it has been inserted into each of said necking dies has an open end, and including the step, after said container has been inserted into a plurality of said necking dies but before said container has been inserted into all of said necking dies, of trimming a further portion from said open end of said neck.

6. A method according to any of claims 2 or 3 wherein said neck after it has been inserted into each of said necking dies has an open end, and including the step, after said container has been inserted into a plurality of said necking dies but before said container has been inserted into all of said necking dies, of trimming a further portion from said open end of said neck, and then including the further step, after said neck has been fully formed, of forming a thread on the open end of said neck.

7. A method according to any of claims 2 or 3 wherein, after said container has been inserted into each of said necking dies and formed therein, said container is ejected from each such necking die, and including the step of using compressed air to assist the ejection of said container from at least some of said necking dies.

8. A method according to any of claims 2 or 3 wherein each necking die comprises a hollow outer die having an internal die surface, and an internal guide member having an external die surface, said internal and external die surfaces defining an annular space of predetermined thickness between them, and including the step of maintaining the thickness of said space at approximately 0.04 to 0.06 mm greater than the thickness of the wall of said container when such wall first enters such space.

9. A method according to any of claims 2 or 3 wherein said elongated, narrowed neck has a narrowest diameter portion of second predetermined diameter, said second predetermined diameter not exceeding one-third of said predetermined diameter.

10. A method according to any of claims 2 or 3 wherein said predetermined diameter is 66 mm and the diameter of said neck at its smallest diameter portion is not greater than 22 mm diameter and the length of said neck is at least 75 mm.

11. A method according to any of claims 2 or 3 wherein said predetermined diameter is 66 mm and the diameter of said neck at its smallest diameter portion is not greater than 22 mm diameter and the length of said neck is at least 100 mm.

12. A method according to any of claims 2 or 3 wherein said metal is an aluminum alloy.

13. A method of forming a long,necked metal container of predetermined diameter, comprising:

(a) impact extruding a slug to form a container having an open end defined by a first encircling edge, (b) trimming a portion from the length of said container at said open end to form a second encircling edge, (c) inserting said container sequentially into a series of necking dies to form an elongated neck of diameter less than said predetermined diameter at said open end, (d) said necking dies comprising a first plurality of necking dies for partially forming said neck and a second plurality of necking dies for completing the forming of said neck, (e) and after said neck has been partially formed in said first plurality of necking dies but before said neck has been completely formed in said second series of necking dies, trimming a further portion from the open end of said neck to form a straight smooth edge thereat.

14. A method according to claim 13 wherein, after each container has been inserted into each necking die and formed therein, said container is ejected from such necking die, and including the step of injecting compressed air into said container to assist in ejecting said container from at least some of said necking dies.

15. A method according to claim 13 wherein each necking die comprises a hollow outer die having an internal die surface, and an internal guide member having an external die surface, said internal and external die surfaces defining an annular space of predetermined thickness between them, and including the step of maintaining the thickness of said space at approximately 0.4 to 0.6 mm greater than the thickness of the wall of said container when such wall first enters such space.

16. A method according to claim 16 wherein said metal is aluminum or an aluminum alloy.

* * * * *

UNITED STATES PATENT AND TRADEMARK OFFICE

CERTIFICATE OF CORRECTION

PATENT NO. : 5,572,893

DATED : November 12, 1996

INVENTOR(S) : Mark E. Goda; Charles Faloney

It is certified that error appears in the above-indentified patent and that said Letters Patent is hereby corrected as shown below:

On the title page, item [54] and column 1, line 1, "AND" should read --AN--.

On the title page, item [73] should read as follows:

[73] Assignee: Advanced Monobloc Corporation
Hermitage, Pennsylvania

Signed and Sealed this

Thirteenth Day of May, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,572,893

DATED : November 12, 1996

INVENTOR(S) : Mark E. Goda; Charles Faloney

It is certified that error appears in the above-indentified patent and that said Letters Patent is hereby corrected as shown below:

Title page item [54], and column 1, should read -- METHOD OF NECKING AN IMPACT EXTRUDED METAL CONTAINER

Title page insert item -- [73] Assignee: Advanced Monobloc Corporation Hermitage, Pennsylvania

Signed and Sealed this

Second Day of September, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,572,893
DATED : November 12, 1996
INVENTOR(S) : Mark E. Goda, et al.

It is certified that error appears in the above-identified patent and that said Letters Patent is hereby corrected as shown below:

In the Claims:

col. 12, line 11 delete "0.4 to 0.6" and insert --0.04 to 0.06-- col. 12, line 14 delete "claim 16" and insert --claim 15--

Signed and Sealed this

Sixteenth Day of May, 2000

*Attest:*

Q. TODD DICKINSON

*Attesting Officer*

*Director of Patents and Trademarks*